US005433520A

United States Patent [19]

Adams et al.

[11] Patent Number: 5,433,520

[45] Date of Patent: Jul. 18, 1995

[54] METHOD AND APPARATUS FOR CONTINUOUSLY PROCESSING PARTICULATE CEMENTITIOUS MATERIAL AND FLY ASH SOLIDS AND MIXING THEM WITH A LIQUID TO PROVIDE A LIQUID SLURRY OF CONSISTENT PROPORTIONS

[75] Inventors: Michael J. Adams, Bay City; Alan G. Falls, Freeland, both of Mich.

[73] Assignee: Michigan Ash Sales Company, Essexville, Mich.

[21] Appl. No.: 166,723

[22] Filed: Dec. 13, 1993

[51] Int. Cl.[6] ..... B28C 7/04; B28C 5/34

[52] U.S. Cl. ..... 366/8; 366/15; 366/19; 366/35; 366/50; 366/152.6; 366/156.2; 222/64; 222/138; 222/145.6; 414/289; 414/505; 414/526

[58] Field of Search ..... 366/3, 6, 8, 10, 13–16, 366/19, 20, 27, 33–35, 37, 38, 40, 50, 132–134, 139, 142, 155, 156, 162, 181, 182, 186, 194–196, 321; 414/289, 326, 502, 505, 523, 526; 222/1, 64, 138, 139, 142, 145, 152

[56] References Cited

U.S. PATENT DOCUMENTS 4,071,226 1/1978 Miller ..... 414/526 X
4,219,279 8/1980 Haws ..... 366/37 X
4,406,548 9/1983 Haws ..... 366/8
4,579,459 4/1986 Zimmerman ..... 366/33 X
4,586,824 5/1986 Haws ..... 366/34
4,768,884 9/1988 Elkin ..... 366/40 X
4,874,283 10/1989 Hurley, Jr. ..... 414/523 X
4,922,463 5/1990 Del Zotto et al. ..... 366/27 X

*Primary Examiner*—Charles E. Cooley
*Attorney, Agent, or Firm*—Learman & McCulloch

[57] ABSTRACT

A controlled method of, and apparatus for, continuously processing initially dry, particulate, cementitious material and fly ash solids and mixing them with a liquid to provide a liquid slurry of consistent proportions. The method and apparatus are concerned with a bin system for the fly ash solids and dry cementitious solids, opposed conveyor flight elements within the bin system leading to a metering valve system, a conveyor system for receiving the fly ash and cementitious material solids in metered proportions and then mixing them with a liquid to form a slurry, a conduit for pneumatically supplying solids entrained in an airstream to the bin system, a pressure controlled system for egressing air from the bin system and separating remaining solids from the air while maintaining the bin system under less than atmospheric pressure, and controls for monitoring the volume of material in the bin system.

17 Claims, 3 Drawing Sheets

METHOD AND APPARATUS FOR CONTINUOUSLY PROCESSING PARTICULATE CEMENTITIOUS MATERIAL AND FLY ASH SOLIDS AND MIXING THEM WITH A LIQUID TO PROVIDE A LIQUID SLURRY OF CONSISTENT PROPORTIONS

BACKGROUND OF THE INVENTION

The present invention is directed to what may be termed flowable cementitious or grout slurries which are useful as fills, which, for example, require lower compressive strength in the range of 5 p.s.i. to 2,000 p.s.i. Typically, the most common fill material mixture comprises an acqueous slurry of cement, coal fly ash, water, and perhaps some other inert fillers. This slurry material, when cured and hardened, has sufficient structural strength to be useful for many purposes. More recently, a slurry utilizing cement, coal fly ash and water, with the coal fly ash being the main ingredient in the ratio of 75% or more, is becoming a fill mixture of choice because the United States Environmental Protection Agency under the Resource Conservation Recovery Act has mandated the use of coal fly ash in concrete for federally funded projects utilizing a designated quantity of concrete, if the coal fly ash—concrete alternative is economically and structurally viable. This mandate was legislated in the United States because of the high cost of land filling the tremendous quantities of coal fly ash, which is the by-product of coal combustion, particularly for the production of electricity.

In the past, the vast majority of such flowable slurries have been produced at ready mix concrete plants and transported to the job site in ready mix concrete trucks. The number of available suppliers of such material was limited to ready mix concrete plants that had the required storage facilities for both cement and coal fly ash. The normal practice was for the cement and coal fly ash to be delivered to the appropriate plant silo via trucks. Then, to be used at a job site, the cement and fly ash were transferred from such storage bins or silos to hoppers, where each was weighed out in a batch type operation to obtain the desired proportions of material. Thereafter, water was added and the materials were completely mixed, either in a concrete drum mixer at the ready mix transfer plant, or in ready mix concrete trucks which delivered the material to the use site. The process was not cost effective for a number of reasons, including the requirement for the ready mix concrete plant to proportion the cement, fly ash and water, the factor that the cement and coal fly ash were transported twice, once to the ready mix concrete plant and thence to the job site, the fact that the ready mix concrete truck could haul only perhaps a maximum of ten cubic yards at one time, thereby requiring far too numerous trips to supply a single project, and finally the requirement that the ready mix concrete truck had to be completely washed after delivery of its fill so as not to contaminate any concrete transported.

Another method of producing the flowable slurry involved mobile concrete mixer trucks which mounted separate hoppers for coal ash and cement, and proportioning and the use of mixing equipment to mix the two products with water to produce a flowable fill at the job site. This use of this type of equipment has been limited, since only a relatively minimum amount of material can be stored in the truck hoppers at any one time, the cement and coal ash are not loaded pneumatically but must be loaded from silos, and the coal ash and cement cannot be loaded simultaneously with the production of slurry.

Finally, in recent years, prior art systems have been used at the job site which utilize separate adjacent fly ash and cement bins feeding a conveyor through metering valves with the dry products being conveyed together, and then mixed and treated with water to produce the flowable slurry. While each of these bins was separately loadable pneumatically during the production of slurry, and a separator was later used to remove the solids from the loading air before releasing it to atmosphere, various problems were encountered which the present invention has solved. Most of the problems encountered were related to the lack of consistency of the end product with respect to the relative proportions of fly ash and cement which were present in the end product and dictated the compressive strength of the cured and solidified product. For example, when the old system was delivering product at a rate of one ton per hour, the relative proportions of ingredients could be off 30% with the result that the slurry continuously supplied to the project varied between 170 p.s.i. and 1,000 p.s.i. in compressive strength.

The present invention is directed to the improvements which have been made in the foregoing system to enable the output of slurry to have proportions within 3% to 4% of the desired proportions in a consistent manner, and to furnish a homogenous slurry which will have the required compressive strength at the twenty-eight day measuring period.

SUMMARY OF THE INVENTION

The present invention utilizes a combination of improvements, which make up the composite method and apparatus which is claimed, to produce a fill much more effectively and accurately within the parameters of a system which requires no outside power source, is trailer or truck mounted to provide service anywhere on a job site, is capable of continually receiving cement and coal ash pneumatically at the job site in an environmentally safe manner and is capable of accurately metering and mixing the cement, coal ash and water at rates, for example, in the neighborhood of up to fifty cubic yards per hour on a continuous basis.

It is a prime object of the invention to achieve consistently proportioned material which will provide a consistent minimum compressive strength when the material is cured and hardens, dependent upon job requirements.

It is another object of the invention to both eliminate bridging in the fly ash and cement bins, and to eliminate the rat-holing effect which occurs when the air blows through to the metering valves.

Another prime object of the invention is to continuously separate the solids from the airstreams loading material into the bins while continuous processing is being achieved, and while maintaining a negative pressure below atmospheric in the fly ash and cement bins so that the bin conveyors and metering valves can effectively perform and deliver a metered supply of material to the conveyor which extends under the bins and receives material from the valves.

Still another object of the invention is to provide hopper or bin controls which control the supply of materials separately to each of the fly ash and cement bins or hoppers by way of suspending operation of the loading operation when the bin is filled, and maintaining the bin contents at a minimum level so that metered amounts can always be fed through the metering valves in an accurate manner.

Another object of the invention is to provide an effective system which is self-sustaining and continuously produces a slurry which can be depended upon to have the desired compressive strength upon curing.

Another object of the invention is to provide a system in which the flow path of material in the fly ash and cement bins continuously forms an an inverted conical bed over the top of each of the metering valves at such depth as to assure a consistent feed of material to the metering valves.

Other objects and advantages of the invention will become apparent with reference to the accompanying drawings and the accompanying descriptive matter.

GENERAL DESCRIPTION

Figure 1:
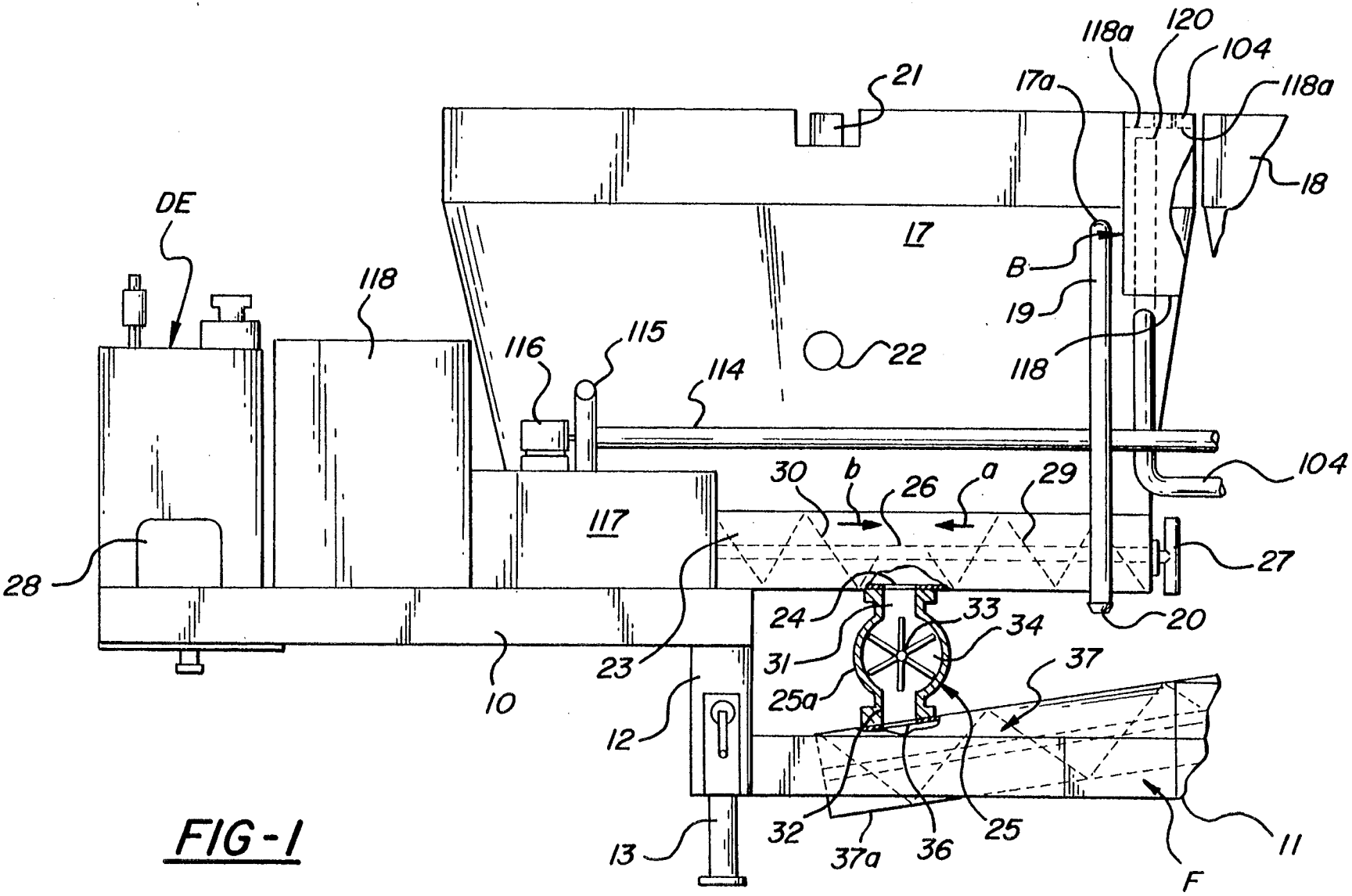
FIGS. 1 and 1A compositely are a schematic side elevational view illustrating apparatus for practicing the system.
Figure 1A:
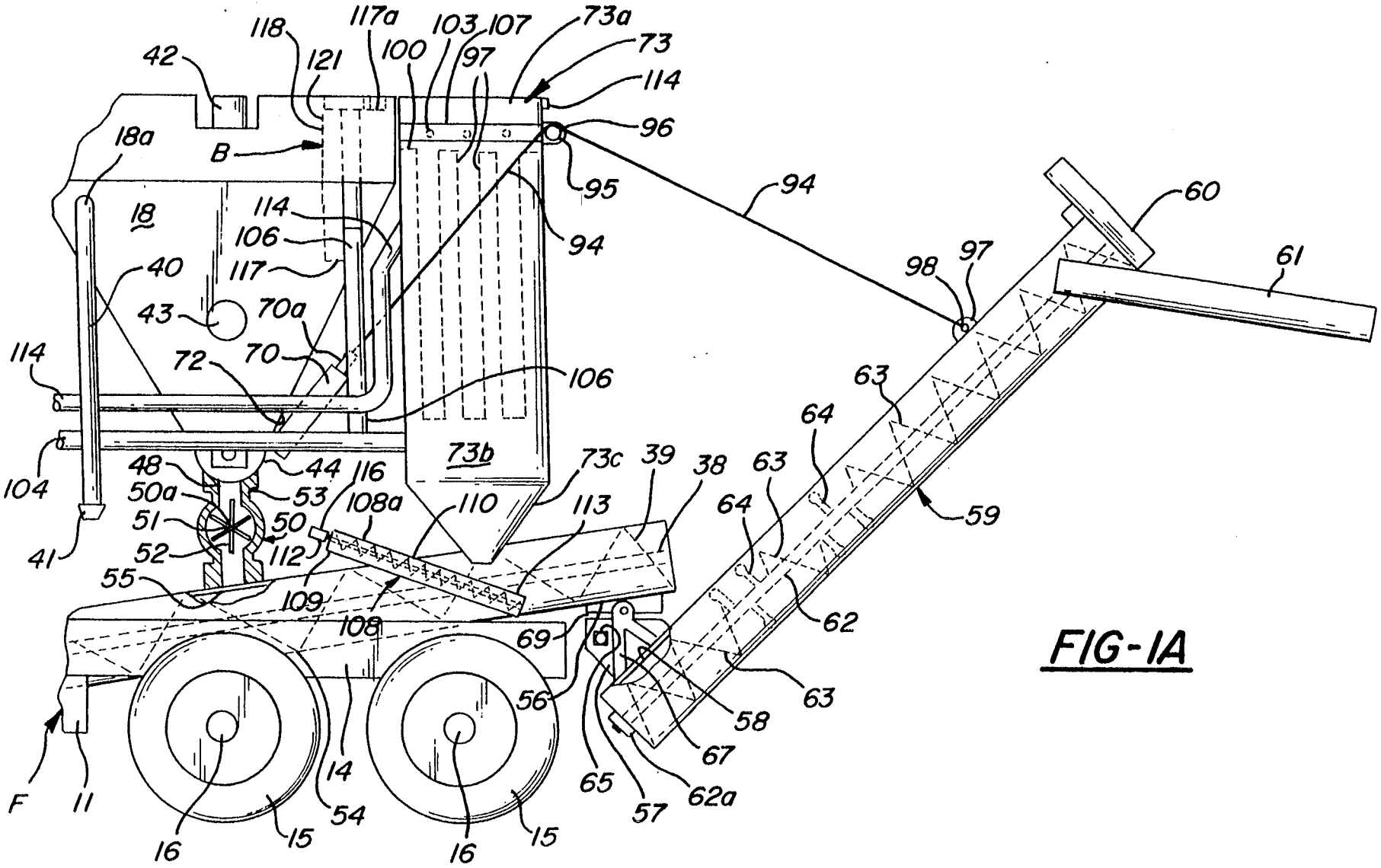

Referring now more particularly to the accompanying drawings and in the first instance to FIGS. 1 and 1A thereof, the system is shown as having a trailer frame, generally designated F, which is made up of a front towing frame section 10 joined to an intermediate frame section 11 by a vertical frame section 12 having lowerable and raisable leveling and supporting elements 13. A rear frame section 14, supported by wheels 15 and axles 16, is joined to the rear end of frame section 11 as shown.

Supported on the frame structure F, is a coal fly ash bin or hopper 17 mounted adjacent a cement bin or hopper 18, also supported by the frame structure F. The bins 17 and/or 18 collectively, or individually, can be termed a bin system. The bin 17 is a completely enclosed bin, which has an opening at 17*a* in communication with a supply pipe 19 with a commercially available quick connect and disconnect end 20 to which a conventional pneumatic hose (not shown) may be connected. The pneumatic hose is one which typically leads from a fly ash supplying truck having a blower fan system for blowing particulate coal ash entrained in an airstream through pipe 19 and into the bin 17 to keep the bin supplied with coal ash material. An in-bin, high level indicating rotary bindicator 21, of conventional design, indicates when the bin 17 is completely filled and electrically activates both a visible alarm and an audible alarm so that an operator can suspend the loading operation through pipe 19. Also provided in communication with the interior of bin 17, is a low level indicating rotary bindicator 22 to indicate by an electrically activated visual and/or audible alarm when the level in bin 17 falls below the level metered by the bindicator 22. The commercially available bindicators 21 and 22 are of the electrical motor-driven paddle wheel type supplied by Bindicator company of Port Huron, Mich. under the trademark ROTOBINDICATOR as its models R-1 and R-7.

The bin 17 converges steeply downwardly at both its ends and sides to deliver material to an open topped, lower bin section 23 which has a metering opening 24 (FIG. 1) in its curvilinear bottom wall vertically opposite a metering valve generally designated 25. Provided in the lower bin section 23, which functions as a conveyor housing, is a continuously driven shaft 26, driven in rotation by a hydraulic motor 27 in hydraulic circuit with a hydraulic pump and reservoir system 28 via an appropriate commercially available hydraulic or electric control system. As schematically illustrated in FIG. 1, right hand spiral vanes or flights 29 and left hand spiral vanes or flights 30, both fixed to the continuously driven drive shaft 26, move material in the opposite directions, indicated by arrows a and b, in opposition to flood the opening 24.

The valve 25 is a schematically illustrated rotary paddle valve which includes an inlet opening 31 at one end and an egress opening 32 at the other. Provided in the curvilinear body 25*a* of the valve 25 is a driven shaft 33 mounting a series of equiangularly spaced paddles 34 having their ends in close fitting, but sliding, relationship with the curvilinear sidewalls 25*a*. Such valves are of conventional construction and deliver precise measured amounts of material from between the pockets formed between their blades or paddles 34 in volumes determined by the speed of normally continuously driven shaft 33. The shaft 33 may be driven by a suitable electric or hydraulic motor at a speed appropriate to achieve the slurry ingredient proportions desired. The opening 32 in the lower end of metering valve 25 communicates with an opening 36 provided in the upper wall of a closed cylindrical auger conveyor, generally designated 37, which mounts a continuously driven shaft 38 having auger flights 39 thereon for moving material from left to right in FIG. 1 within conveyor housing 37*a*.

Like bin 17, the bin or hopper 18 has an opening 18*a* (FIG. 1A) for admitting a material supplying pipe 40 through which cement or cementitious material in powder form may be blown into the bin 18. The pipe 40 has a similar quick connect and disconnect coupling 41 to which a pneumatic pipe leading from a cement truck having a blower system for blowing entrained cement into pipe 40 connects. If desired and necessary, more than a single fill pipe 40 or fill pipe 19 can be utilized with each of the bins 18 and 17. Also, a bindicator 42, of the same character as bindicator 21, functions as a high level bindicator to electrically activate both a visible and audible alarm when the bin 18 is full so that the operator can shut off the supply of material to pipe 40. A low level bindicator 43, of the same character as bindicator 22, functions to warn the operator in the same manner when the supply of material within the bin 18 is reaching a predetermined low level. Normally the supply of material through pipe 40 is discontinuous on a "need" basis and takes place while the system is in operation, when the low level bindicator 43 indicates that the bin needs replenishing.

Figure 2:
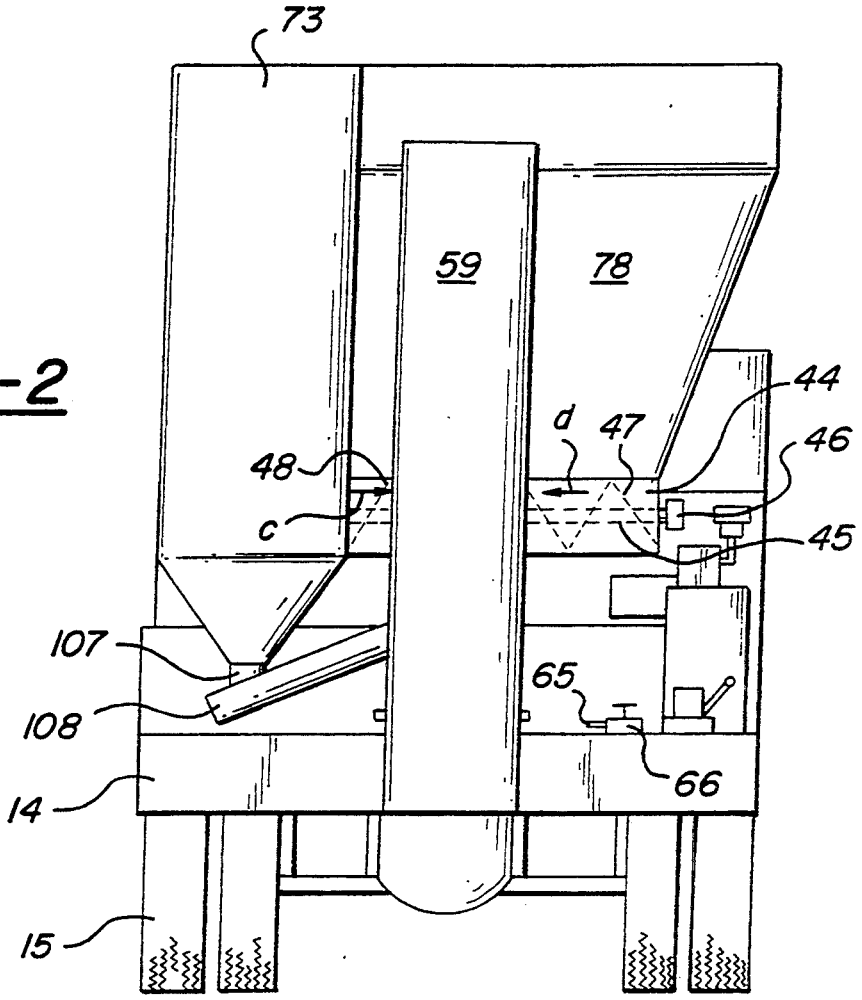
FIG. 2 is a schematic end elevational view thereof taken from the right end of FIG. 1.

As FIGS. 1 and 2 both indicate, the bin 18 also steeply converges downwardly to an open topped lower bin section or housing 44 of cylindrical cross-section which is, however, disposed crosswisely to the conveyor housing 23. Mounted by the housing 44, which functions as a conveyor housing, is a continuously driven shaft 45 (FIG. 2) which may be driven by a suitable hydraulic motor 46 driven via the pump 28 and hydraulic control system at a controlled variable speed. Right hand auger flights 47 are fixed to the right end of the shaft 45 in FIG. 2 and left hand auger flights 48 are fixed to the left end of shaft 45, as shown in FIG. 2. The auger flights 47 and 48 deliver material in the opposite directions indicated by the arrows c and d to flood an opening 49 in the bottom of housing 44 which leads to a metering valve, generally designated 50 (FIG. 1A), of exactly the same construction as the metering valve 25. As previously, the valve 50, which is, however, smaller in size and delivers a lesser volume of material, includes a hydraulically or electrically driven shaft 51 on which paddles 52 are fixed, to form closed compartments between them as they rotate past the curvilinear walls 50*a* of the metering valve housing. Valve 50 similarly has an inlet opening 53 in communication with the opening 49 in conveyor housing 44, and an egress opening 54 leading to an opening 55 provided in the upper wall of the conveyor housing 37*a*. The conveyor flights 29–30, paddles 34, conveyor flights 47–48 and paddles 52 can be collectively generally termed a first conveyor system.

At the rear end of conveyor housing 37*a* an opening 56 communicates with a flexible connecting conduit or boot 57 leading to an opening 58 in the left end of the cylindrical housing 59*a* of a slurry conveyor system, generally designated 59. The housing 59*a* is closed except for an open end 60 which delivers the slurry to its discharge chute 61. A continuously driven shaft 62, driven by a suitable hydraulic motor 62*a* and the hydraulic pump system, has forwarding auger flights 63 thereon, and also mixing paddles 64. There is an initial section of forwarding flights 63 at the left end of the conveyor 59, then a series of forwarding mixing paddles 64, then another forwarding flight section 63, then a further series of forwarding mixing paddles 64 in which the material is further mixed prior to being delivered to a final section of forwarding flights 63. Water under tap pressure is supplied to the boot 57 via a pipe 65 (FIG. 2) in a continuous manner through a metering valve 66 (see FIG. 2) which can be adjusted to admit the desired volume of water to the mix. The dry mix blending conveyor 37 and the slurry mixing conveyor 59 may be collectively termed a second conveyor system.

It will be noted that the conveyor 59 incorporates leg structure 67 (FIG. A) which is pivotally mounted on trunnions 68 supported by strap structure 69 which is supported for pivotal movement in a lateral plane to provide the conveyor 59 with universal joint movement. A hydraulic cylinder 70 (FIG. 1A), pivotally connected at 71 to a bracket 72 (provided) which may be supported exteriorly on bin 18 has its piston rod 70*a* connected with a cable 94. Cable 94 passes up around a pulley 95, supported by a bracket 96 on the frame F, and then connects as at 98 to a bracket 97 fixed to the conveyor housing 59. The structure described permits the conveyor 59 to be supported at a proper angle relative to a discharge trough 61, or to be folded in to the separator bin structure 73 for transport to and from the job site.

A separator or bag house bin structure 73, supported on frame F, in the usual manner, provides spaced apart rows of flexible perforate cloth or paper bags 99, hanging from a support plate structure 100, which collectively partition the bag house bin structure 73 into an upper compartment 73*a* and a lower compartment 73*b*. Located above the bags 99 in the compartment 73*a*, which is effectively separated from the rest of the bag house bin structure by the rows of bags 99, is an air manifold 102 having a series of jet nozzles 103 provided thereon at intervals to intermittently emit pulses of high pressure air, in the neighborhood of 100 p.s.i., for example, to remove material collected on the bags 99.

Conduit 104 (FIG. 1A) leads from the fly ash bin 17 over to the lower portion 73*b* of bin structure 73, and it will be noted that a pipe 106, leading from the bin 18, connects into the pipe 104 before it empties into the lower chamber 73*b* within bag house bin structure 73. The lower end of the bin structure 73 converges as shown at 73*c* and terminates in an outlet pipe 107 leading to an auger conveyor, generally designated 108, which extends downwardly into the interior of dry blend conveyor 37 through an opening 105 in conveyor housing 37*a*. Auger conveyor housing 108*a* is mounted on supports 109 and mounts a continuously rotating shaft 110 having forwarding flights 111 fixed thereon to deliver material from the pipe 107 to the interior of conveyor 37 through an open lower end portion of conveyor housing 108*a*. The shaft 110 may be powered by a suitable hydraulic motor 112.

Leading from the bag-isolated upper compartment 73*a* of the bin structure 73 is a pipe or conduit 114 which is of a flexible nature to wrap around the bin structure 73 and lead from the left side thereof in FIG. 1A over to a vent fan 115 (FIG. 1) driven by an electric motor 116. The continuously operating fan 115 exerts a sufficient draft to maintain a below atmospheric or negative pressure in the upper compartment 73*a* of separator bin structure 73, the lower compartment 73*b* thereof, the pipes 104 and 106, and, very importantly, the bins 17 and 18. Typically a negative pressure in the neighborhood of three to four inches of water is maintained in the bins 17 and 18. The pipes 104, 106, separator structure 73, pipe 114 and fan 115, which exits clean air to the environment, may be termed a pressure controlled system for both deentraining solids and for maintaining the bins under a negative pressure. Typically, the trailer frame F may support a fuel tank 107 for a diesel engine DE which powers the pump 28 and hydraulic system. It further supports an air compressor 118 which supplies the air manifold 102 in the separator bin structure 73.

Provided in each of the bins 17 and 18 is an interior baffle box, generally designated B, which is formed of side and end walls 117 and 118. The side and end walls 117 and 118 are inperforate except for cutouts 117*a* and 118*a* provided at their upper ends which communicate the upper end of the baffle box B with the other portion of bin 17. The baffle box B provides an open-bottomed interior compartment 120 within hopper or bin 17 for the pipe 104 which projects up into the compartment 120 as shown in FIG. 1 for the purpose of withdrawing air and delivering it to the separator or bag house structure 73. A similar baffle box B is employed in the bin 18 to provide a similar open-bottomed compartment 121 into which the air withdrawal tube 106 projects upwardly.

THE PRIOR ART

Previously, more than a year prior to filing the present application, applicants' assignee used a system which, while producing a slurry sufficiently consistent for some purposes, could be off in the neighborhood of 30% in the relative proportions of the dry blend delivered by conveyor 37 at any one time. The improvements of the present invention are directed to structure and methods for achieving the consistency desired for many jobs. In the prior art machine to which reference is made, the pressure in bins 17 and 18 was positive and there was simply a one-way auger conveyor under each of the bins 17 and 18, as opposed to conveyors with left and right hand flights 29 and 30, and 47 and 48. Low level bindicators 22 and 43 were not used. The entrained dust, consisting of both fly ash and cement, removed by the separator or bag house structure 73, was augered back to the fly ash bin 17. It proved to be difficult to blow the separated dust back into the bin 17, which was under a positive pressure which was further increased by the airstream in which the separated dust was entrained. Additionally, there were no baffle boxes B into which the air discharge pipes 104 and 106 projected. Air under pressure, used to blow material into the bin 17 and 18 by way of the pipes 19 and 40, provided a positive air pressure within the bins 17 and 18 which then moved under the positive pressure through the egress pipes 104 and 106 to the separator 37. There was no vent fan creating a draft which maintained the fly ash bin and the cement bin under a less than atmospheric pressure. What occurred, with positive air pressures in bins 17 and 18 and no internal in-bin augers or conveyors, was a so-called "rat-holing" effect at the metering valves 25 and 50, with air blowing or surging through these valves at intervals, to disrupt the proportionate volumes of material delivered by the valves 25 and 50 to the dry blending, transition conveyor 37.

THE OPERATION

It is to be understood that the present system is capable of operating virtually continuously, and this is accomplished by maintaining a continuous flow of fly ash-containing trucks and cement trucks to the site which can be pneumatically coupled to deliver material through the pipes 19 and 40, while the system is operating. Typically, the material supplied to bin 17 is coal fly ash which is a mixture of silica, alumina and carbon in perhaps a proportion of 1%–12% carbon. Since the proportion of fly ash used is so much greater than the proportion of cement used, the loading operation for fly ash through pipe 19 is maintained continuously whereas the cement loading operation through pipe 40 need only be maintained sporadically. Of course, if either of the bindicators 21 or 42 indicate that the tank is full, the operator suspends the loading operation for a time to empty the bins partially, prior to resuming the loading operation. Theoretically, neither of the bindicators 22 or 43 should ever be permitted to be revolved by the material. If this occurs in bin 18, there is normally time to supply an additional quantity of cement through pipe 40, without the need for shutting down the system. If this occurs in bin 17, however, by way of bindicator 22 being free to revolve, the system may be shut off for a sufficient period of time to permit a resupply operation through pipe 19, prior to starting the system up once again.

Figure 3:
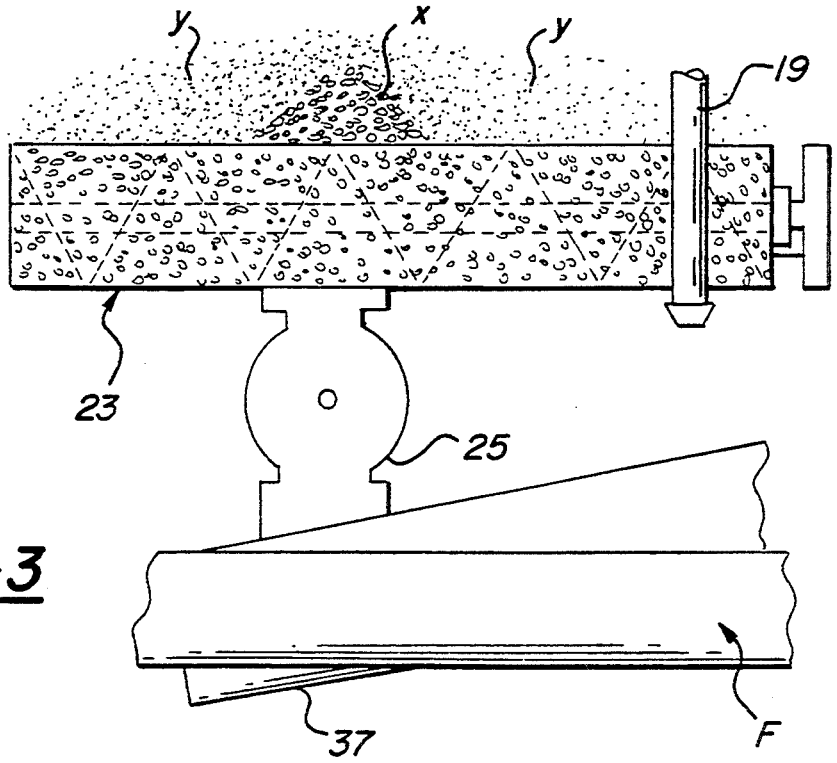
FIG. 3 is a fragmentary side elevational schematic view illustrating the flow of material in the fly ash and cement bins.

Because the flights 29 and 30 feed material in opposite directions, a considerable cone of substantially aerated material x (shown in FIG. 3) builds up above the opening 24 and above the valve opening 53. Relatively aerated material is illustrated in FIG. 3 at y. With the present system, there is no rat-holing, as previously was the case, and the feed through valve 25 is a constant feed to provide the consistency which is necessary to certain operations. The same effect is achieved in bin 18 via the flights 47–48. Thus the valves 25 and 50 are continually flooded with the material piling up in the cone shape x at both the valves 25 and 50 to positively prevent any possibility of voids within the valves 25 and 50.

The speeds of rotation of metering valve shafts 33 and **50*a* are variable and normally tachometers are provided in relationship to the metering valve shafts to enable them to be set to run at a speed which permits the fill trucks to keep up with the processing operation and to provide consistent blending of the two dry products. Typically, the valves are run at speeds which produce a dry blend of material in conveyor 37 in which the coal fly ash is present in the amount of 95% and the cement in the amount of 5% by volume. When the inverted cones of material x are not being formed, the operator may take both of the speeds down 10%, for example, to provide an operation in which these inverted cones are formed. Other jobs may specify as much as, for example, 30% cement and in other cases an 85% coal ash to 15% cement by volume is desired. The water supplied through pipe 66 is supplied by the valve 65** in a flow sufficient to make a flowable slurry. Typically, the water will be roughly 50%–60% by weight of the dry blended product and will be furnished in the amount of around one hundred five gallons per yard of dry blended mix.

The air which is delivered with entrained material, which largely separates out or de-entrains in the bins 17 and 18, is withdrawn by the conduits 104 and 106 to the lower compartment **73*b* in the separator bin structure 73. Between intervals in which the air pressure is pulsed through nozzles 103, the air is drawn into contact with the pervious bags 99 and material which remains entrained is deposited on the exterior of the bags 99. The pulses through nozzles 103 typically are of a quarter second duration. The pulsing of high pressure air through the nozzles 103 removes this dust, which consists of both fly ash and cement, to the lower end of compartment 73*b* and the pipe 107, and continuously operating auger shaft 110 then feeds it under a mechanically maintained positive pressure into conveyor 37. The augers 111 must be sufficiently tight with respect to the auger casing that they are capable of forcing the material into the conveyor housing 37. With a negative pressure maintained in separator bin compartment 73*b* material separated out by the bags 99 tends to drop by gravity to the pipe 107, rather than reentrain in the air entering via pipe 104. It is the vent fan 115 which maintains the negative pressure in the system and, as will be seen, this pipe connects to the upper end of the separator bin 73 to communicate with the compartment 73*a* and provide sufficient pull to create and maintain the less than atmospheric pressure in the system. With the dry blend from conveyor 37 and the water from pipe 65 proceeding through the boot 57, the material in conveyor 59 is first advanced and somewhat blended, and then more thoroughly mixed by the paddles 64. The paddles 64 provide a more intense mixing action and it is to be noted that there are two sets of separated paddles 64 provided in intensive mixing zones in conveyor 59 between the interrupted conveyor flights 63. The flow of material out the end 60 of conveyor 59 to trough 61 is continuous and of consistent quality. There is no surging of material through valves 25 and 50 which can operate to destroy this consistency, with the present improved system. With the vent fan 115**, the flow of slurry can in effect be fine tuned to provide a consistency which is generally within 3% to 4% and furnishes better than the required minimum compressive strength.

It is to be noted that all the bin walls 17, 18 and 73 in their convergent sections are of at least a 53° angle such that the material does not tend to hang up on the walls. Of course, conventional vibrating mechanisms can be introduced to vibrate the bin walls, should this ever become necessary.

In an alternative form of the invention, it is hypothesized that it may be possible to provide only a single bin in which a preblend of coal fly ash and cement is dispensed at the site through a single metering valve to the conveyor 37, while continuous loading of the pre-blend is occurring. In addition to fly ash, one of the ingredients which is dry blended or preblended can be the kiln dust from a lime or cement plant, or any Portland cement, or other dry cementitious product.

It is to be understood that the embodiments described are exemplary of various forms of the invention only and that the invention is defined in the appended claims which contemplate various modifications within the spirit and scope of the invention.

We claim:

1. A controlled method of continuously processing initially dry, particulate, cementitious and fly ash material solids and mixing them with a liquid to provide a liquid slurry of consistent proportions in an apparatus comprising: a bin for fly ash solids adjacent a bin for dry cementitious solids, first discharge conveyor systems incorporated with each of said bins including metering outlet valves with inlets communicating with said bins and valve outlets, a second conveyor system in communication with said valve outlets for receiving said fly ash and cementitious material solids in metered proportions from said valves and mixing said ash and cementitious solids with a liquid to form a slurry, conduits for pneumatically separately supplying cementitious material solids entrained in an airstream to said cementitious material bin and fly ash solids entrained in an airstream to said fly ash bin, a pressure controlled air outlet system for egressing the airstream from each of said bins and separating fly ash and cementitious solids remaining entrained therein from the airstreams while maintaining the bins under less than atmospheric pressure, and controls for monitoring the volume of fly ash and cementitious solids in their respective bins; the steps of:

(a) loading said respective bins by blowing fly ash and cementitious solids entrained in airstreams carried in said conduits into said respective fly ash and cementitious solids bins and substantially deentraining the fly ash and cementitious solids carried therein;

(b) while so loading said bins, simultaneously unloading the fly ash and cementitious solids in said bins to said valves by traveling said fly ash solids in the fly ash bin and the cementitious solids in the cementitious solids bin in opposed flow path streams to flood the valve inlet communicating with each bin;

(c) receiving said fly ash and cementitious solids in said second conveyer system and mixing said fly ash and cementitious solids and said liquid to form a slurry;

(d) providing suction in said pressure controlled air outlet system which withdraws air from each of said bins and maintains a less than atmospheric pressure in said bins to permit said fly ash and cementitious solids to move to and through said valves in a uniform volumetric flow without surges; and (e) substantially separating the remaining entrained fly ash and cementitious solids from said withdrawn air.

2. The method of claim 1 wherein said separated remaining solids are continuously removed from said pressure controlled air outlet system and augured into said second conveyor system under mechanically applied pressure.

3. The method of claim 1 wherein said solids are metered into said second conveyor system from said bins in a ratio of at least 50% fly ash to 50% cementitious material by volume.

4. The method of claim 3 wherein said ratio is about 95% fly ash to 5% cementitious material.

5. The method of claim 1 wherein said liquid is added in the ratio of about 50% to 60% of the combined fly ash and cementitious material by weight.

6. The method of claim 1 wherein said valves are operated at a rate such that said flow path streams moving in opposition meet to form inverse cones of solids in said bins above the inlets of said metering valves.

7. The method of claim 1 wherein said controls include a level measuring device incorporated in the fly ash bin and the loading and unloading of said fly ash bin is performed continuously unless the level measuring device in the fly ash bin indicates the level to be too low or too high.

8. A controlled method of continuously processing initially dry, particulate, cementitious and fly ash material solids and mixing them with a liquid to provide a liquid slurry of consistent proportions in an apparatus comprising: a bin system for dry fly ash solids and dry cementitious solids, a first discharge conveyor system incorporated with said bin system including a metering valve system having an outlet system, a second conveyor system communicating with said outlet system for receiving said fly ash and cementitious material solids from said valve system and mixing said fly ash and cementitious solids with a liquid to form a slurry, a conduit structure for pneumatically supplying fly ash and cementitious solids entrained in an airstream flow to said bin system, a pressure controlled air outlet system for egressing air from said bin system and separating fly ash and cementitious solids remaining entrained therein from the air while maintaining the bin system under less than atmospheric pressure, and a control system for monitoring the volume of fly ash and cementitious solids in said bin system; the steps of:

(a) loading said bin system by blowing fly ash and cementitious solids entrained in an airstream through said conduit structure into said bin system and substantially deentraining the fly ash and cementitious solids carried therein;

(b) while so loading said bin system, moving fly ash and cementitious solids in said bin system to said valve system by traveling flows of fly ash and cementitious solids to said metering valve system to maintain said metering valve system flooded with fly ash and cementitious solids;

(c) receiving said fly ash and cementitious solids in said second conveyer system and mixing said fly ash and cementitious solids and said liquid to form a slurry;

(d) providing suction in said pressure controlled air outlet system which withdraws air from said bin system and maintains a less than atmospheric pressure in said bin system to work with the flooding of the valve system with fly ash and cementitious solids to provide a uniform volumetric flow through said valve system without surges; and (e) substantially separating the remaining entrained fly ash and cementitious solids from air withdrawn by said pressure controlled air outlet system.

9. Apparatus for continuously processing initially dry, particulate, cementitious and fly ash material solids and mixing them with a liquid to provide a liquid slurry of consistent proportions comprising:

(a) a relatively high volume bin system for fly ash solids and dry cementitious solids;

(b) a first discharge conveyor system incorporated with said bin system including a metering valve system having an outlet and including continuously driven, oppositely directed conveyors in said bin system for traveling flows of said fly ash and cementitious solids in opposed streams directed one against the other to maintain said metering valve system flooded with said fly ash and cementitious solids;

(c) a second conveyor system communicating with said metering valve outlet for receiving said fly ash and cementitious material solids from said valve system and mixing said fly ash and cementitious solids with a liquid to form a slurry;

(d) a relatively low volume conduit structure communicating with said bin system for pneumatically supplying fly ash and cementitious solids entrained in an airstream to said bin system where they substantially deentrain;

(e) a pressure controlled air outlet system communicating with said bin system for egressing air from said bin system and for separating non-deentrained remaining solids from said egressed air while continuously maintaining the bin system under a negative pressure; and (f) a control system for monitoring the volume of fly ash and cementitious solids in said bin system.

10. The apparatus of claim 9 wherein said pressure controlled air outlet system includes a suction fan for providing suction in said pressure controlled air outlet system and maintaining a less than atmospheric pressure in said bin system to create, with the travel of said solids in opposed streams, a uniform volumetric flow through said valve system without surges.

11. The apparatus of claim 9 including an auger mechanism, leading from said pressure controlled air outlet system into said second conveyor system, which is operated continuously to auger said fly ash and cementitious solids separated from said air into said second conveyor system under mechanically applied pressure.

12. The apparatus of claim 9 wherein a water inlet is provided in said second conveyor system.

13. The apparatus of claim 9 wherein said control system includes level measuring devices for indicating low and high level condition in said bin system.

14. The apparatus of claim 9 wherein said bin system includes a separate bin for fly ash and a separate bin for cementitious material and said valve system includes a continuously revolving separate valve, with an inlet and outlet, for each bin.

15. The apparatus of claim 14 in which each separate bin includes at least one of said oppositely directed conveyors which meet at the inlet of one of said separate valves.

16. The apparatus of claim 9 wherein said pressure controlled air outlet system has a vacuum duct leading from said bin system and includes a bag house separator structure, and said bin system has a bin with an upper protected compartment with upper and lower ends separated in part from the remainder of the said bin into which said duct extends, said compartment having upper end openings communicating with another part of the said bin.

17. The apparatus of claim 16 wherein said compartment includes imperforate side walls except at the upper end and is open at the lower end.

* * * * *